US008957589B2

(12) United States Patent
Li

(10) Patent No.: US 8,957,589 B2
(45) Date of Patent: Feb. 17, 2015

(54) LED LIGHT-ADJUSTMENT DRIVER MODULE, BACKLIGHT MODULE AND LIQUID CRYSTAL DISPLAY DEVICE

(71) Applicant: Shenzhen China Star Optoelectronics Technology Co., Ltd., Shenzhen, Guangdong (CN)

(72) Inventor: Fei Li, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 191 days.

(21) Appl. No.: 13/701,868

(22) PCT Filed: Nov. 27, 2012

(86) PCT No.: PCT/CN2012/085338

§ 371 (c)(1),
(2) Date: Dec. 4, 2012

(87) PCT Pub. No.: WO2014/079076

PCT Pub. Date: May 30, 2014

(65) Prior Publication Data

US 2014/0139123 A1 May 22, 2014

(30) Foreign Application Priority Data

Nov. 21, 2012 (CN) ..... 2012 1 0475568

(51) Int. Cl.
*H05B 33/08* (2006.01)

(52) U.S. Cl.
CPC ..... *H05B 33/0815* (2013.01)
USPC ..... 315/172; 315/185 S; 315/246; 315/247

(58) Field of Classification Search
CPC ..... H05B 33/0815
USPC ..... 315/185 S, 246, 247, 209 R, 285, 291, 315/299–301, 307, 308, 312, 172
See application file for complete search history.

(56) References Cited

U.S. PATENT DOCUMENTS

| | | | | |
|---|---|---|---|---|
| 7,106,036 | B1 * | 9/2006 | Collins | 323/282 |
| 7,999,484 | B2 * | 8/2011 | Jurngwirth et al. | 315/247 |
| 2008/0136350 | A1 * | 6/2008 | Tripathi et al. | 315/294 |
| 2009/0184666 | A1 * | 7/2009 | Myers et al. | 315/297 |
| 2012/0139434 | A1 * | 6/2012 | Hsu et al. | 315/210 |
| 2012/0223649 | A1 * | 9/2012 | Saes et al. | 315/186 |

* cited by examiner

*Primary Examiner* — Douglas W Owens
*Assistant Examiner* — Pedro C Fernandez
(74) *Attorney, Agent, or Firm* — Andrew C. Cheng

(57) ABSTRACT

An LED light-adjustment driver module includes a duty cycle detection unit, a current output unit, a comparator and a capacitor unit. The first input end of comparator is connected to capacitor unit, and the second input end of comparator inputs a default threshold voltage. The duty cycle detection unit is for receiving externally inputted PWM signal and detecting the duty cycle of the PWM signal; when the duty cycle detection unit detects the duty cycle is less than a default threshold, the current output unit increases the output current or the capacitor unit reduces the capacitance provided to reduce the time for the voltage of the capacitor unit to reach the threshold voltage. Hence, the charging speed of the capacitor unit can be increased.

18 Claims, 3 Drawing Sheets

LED LIGHT-ADJUSTMENT DRIVER MODULE, BACKLIGHT MODULE AND LIQUID CRYSTAL DISPLAY DEVICE

BACKGROUND OF THE INVENTION

1. Field of the Invention

The present invention relates to the field of LED light-adjustment techniques, and in particular to an LED light-adjustment driver module, backlight module and liquid crystal display device.

2. The Related Arts

Due to the advantages of low energy-consumption, environmental friendliness and high efficiency, the LED backlight is widely adopted in many applications.

Because the luminance of the backlight must be adjusted, light-adjustment must be performed on LED. At present, the majority of the light-adjustment uses pulse width modulation (PWM) technique. Referring to FIG. 1, FIG. 1 is a schematic view showing the structure of a known LED light-adjustment driver circuit. The LED light-adjustment driver circuit comprises a comparator A, a current source S and a capacitor C; one end of capacitor C being connected a first input end of the comparator A, and the other end being grounded. The current source S is connected to the first input end of the comparator A. A second input end of the comparator A inputs a threshold voltage V. The LED light-adjustment driver circuit will respond to PWM signal P. When PWM signal P is high, current source S outputs a current to charge capacitor C. When the voltage of capacitor C rises to exceed the threshold voltage V, the comparator A outputs high for adjusting the luminance of the LED backlight.

However, when the known LED light-adjustment driver circuit adjusts the luminance of the LED backlight, a flickering problem exists. In the condition that the duty cycle of the PWM signal P is small, when the LED backlight is lit for the second time, because a voltage exists on the capacitor C, the voltage is backlight, but will only last for a short time. Then, the current source S charges the capacitor C. Because the duty cycle of the PWM signal P is small, the charge time for the capacitor C is short. Therefore, the voltage on capacitor C will not reach the threshold voltage V. Only after the PWM signal P goes through a plurality of high levels, the voltage on capacitor C can exceed the threshold voltage V, and the comparator A can output high level to light LED backlight. During lighting the LED backlight, because the voltage on capacitor C takes longer time to reach the threshold voltage V, a flickering problem occurs, which affects the lighting quality.

SUMMARY OF THE INVENTION

The technical issue to be addressed by the present invention is to provide an LED light-adjustment driver module, backlight module and liquid crystal display device, to avoid the flickering problem.

The present invention provides an LED light-adjustment driver module, which comprises: a duty cycle detection unit, a current output unit, a comparator and a capacitor unit; the first input end of the comparator being connected to capacitor unit, the second input end of the comparator inputting a default threshold voltage; the current output unit being connected to the capacitor unit for charging the capacitor unit; the duty cycle detection unit being for receiving externally inputted PWM signal and detecting the duty cycle of the PWM signal; when the duty cycle detection unit detecting the duty cycle being less than a default threshold, the current output unit increasing the output current or the capacitor unit reducing the capacitance provided to reduce the time for the voltage of the capacitor unit to reach the threshold voltage.

According to a preferred embodiment of the present invention, when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

According to a preferred embodiment of the present invention, when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

According to a preferred embodiment of the present invention, the current output unit comprises a first control switch, a first current source and a second current source; the capacitor unit comprises a first capacitor; wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch; the first control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end; the first current source is connected to the second end of the first control switch and outputs a first current; the second current source is connected to the third end of the first control switch and outputs a second current; one end of the first capacitor is connected to the fourth end of the first control switch and the first input end of the comparator; the other end of the first capacitor is grounded.

According to a preferred embodiment of the present invention, the current output unit comprises a third current source; the capacitor unit comprises a second control switch, a second capacitor and a third capacitor; wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch; the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end; one end of the second capacitor is connected to the second end of the second control switch; the other end of the second capacitor is grounded; the second capacitor provides a first capacitance; one end of the third capacitor is connected to the third end of the second control switch; the other end of the third capacitor is grounded; the third capacitor provides a second capacitance; the third current source is connected to the fourth end of the second control switch and the first input end of the comparator.

According to a preferred embodiment of the present invention, the duty cycle detection unit, the current output unit and the comparator are packaged in a single package.

The present invention provides a backlight module, which comprises: an LED light and an LED light-adjustment driver module; the LED light-adjustment driver module further comprising: a duty cycle detection unit, a current output unit, a comparator and a capacitor unit; the first input end of the comparator being connected to capacitor unit, the second input end of the comparator inputting a default threshold voltage; the current output unit being connected to the capacitor unit for charging the capacitor unit; the duty cycle detection unit being for receiving externally inputted PWM signal and detecting the duty cycle of the PWM signal; when the duty cycle detection unit detecting the duty cycle being less than a default threshold, the current output unit increasing the output current or the capacitor unit reducing the capacitance provided to reduce the time for the voltage of the capacitor unit to reach the threshold voltage; the output end of the comparator outputting a high level or a low level to adjust the luminance of the LED light.

According to a preferred embodiment of the present invention, when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

According to a preferred embodiment of the present invention, when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

According to a preferred embodiment of the present invention, the current output unit comprises a first control switch, a first current source and a second current source; the capacitor unit comprises a first capacitor; wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch; the first control switch comprises a first end, a second end, a third end and a fourth end, the first end is connected to the duty cycle detection unit; when the first end receives the first control signal; the fourth end is connected to the second end; when the first end receives the second control signal; the fourth end is connected to the third end; the first current source is connected to the second end of the first control switch and outputs a first current; the second current source is connected to the third end of the first control switch and outputs a second current; one end of the first capacitor is connected to the fourth end of the first control switch and the first input end of the comparator; the other end of the first capacitor is grounded.

According to a preferred embodiment of the present invention, the current output unit comprises a third current source; the capacitor unit comprises a second control switch, a second capacitor and a third capacitor; wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch; the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end; one end of the second capacitor is connected to the second end of the second control switch; the other end of the second capacitor is grounded; the second capacitor provides a first capacitance; one end of the third capacitor is connected to the third end of the second control switch; the other end of the third capacitor is grounded: the third capacitor provides a second capacitance; the third current source is connected to the fourth end of the second control switch and the first input end of the comparator.

According to a preferred embodiment of the present invention, the duty cycle detection unit, the current output unit and the comparator are packaged in a single package.

The present invention provides a liquid crystal display device, which comprises: a backlight module; the backlight module comprising: an LED light and an LED light-adjustment driver module; the LED light-adjustment driver module further comprising: a duty cycle detection unit, a current output unit, a comparator and a capacitor unit; the first input end of the comparator being connected to capacitor unit, the second input end of the comparator inputting a default threshold voltage; the current output unit being connected to the capacitor unit for charging the capacitor unit; the duty cycle detection unit being for receiving externally inputted PWM signal and detecting the duty cycle of the PWM signal; when the duty cycle detection unit detecting the duty cycle being less than a default threshold, the current output unit increasing the output current or the capacitor unit reducing the capacitance provided to reduce the time for the voltage of the capacitor unit to reach the threshold voltage, the output end of the comparator outputting a high level or a low level to adjust the luminance of the LED light.

According to a preferred embodiment of the present invention, when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

According to a preferred embodiment of the present invention, when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

According to a preferred embodiment of the present invention, the current output unit comprises a first control switch, a first current source and a second current source; the capacitor unit comprises a first capacitor; wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch; the first control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end: the first current source is connected to the second end of the first control switch and outputs a first current; the second current source is connected to the third end of the first control switch and outputs a second current; one end of the first capacitor is connected to the fourth end of the first control switch and the first input end of the comparator; the other end of the first capacitor is grounded.

According to a preferred embodiment of the present invention, the current output unit comprises a third current source; the capacitor unit comprises a second control switch, a second capacitor and a third capacitor; wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch; the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end; one end of the second capacitor is connected to the second end of the second control switch; the other end of the second capacitor is grounded; the second capacitor provides a first capacitance; one end of the third capacitor is connected to the third end of the second control switch; the other end of the third capacitor is grounded; the third capacitor provides a second capacitance; the third current source is connected to the fourth end of the second control switch and the first input end of the comparator.

According to a preferred embodiment of the present invention, the duty cycle detection unit, the current output unit and the comparator are packaged in a single package.

In summary, through increasing the output current of the current output unit or reducing the capacitance provided by the capacitor unit, the LED light-adjustment driver module, backlight module and LCD of the present invention can increase the charging speed of the capacitor unit to reduce the time required for the voltage of the capacitor unit to reach the threshold voltage, avoid the flickering problem and improve the lighting quality.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
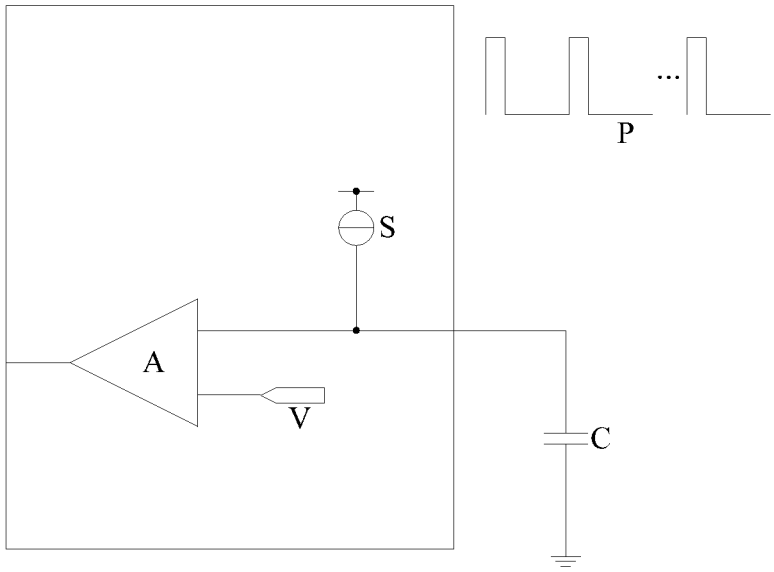
Figure 1 (Prior Art)
FIG. 1 is a schematic view showing the structure of a known LED light-adjustment driver circuit.
Figure 2:
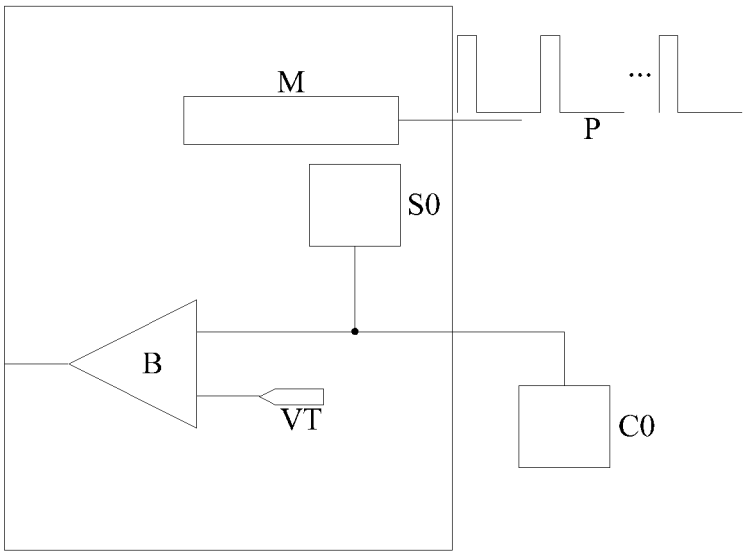
FIG. 2 is a schematic view showing the circuit of the first embodiment of an LED light-adjustment driver module according to the present invention.

The following provides a clear and complete description of the technical solution according to the present invention using the drawing and the embodiment. Apparently, the drawings described below show only example embodiments of the present invention, instead of all embodiments. For other embodiments based on the disclosed drawings and embodiments, and obtained by those having ordinary skills in the art without paying any creative effort are also within the scope of the present invention, Referring to FIG. 2, FIG. 2 is a schematic view showing the circuit of the first embodiment of an LED light-adjustment driver module according to the present invention. The LED light-adjustment driver module comprises a duty cycle detection unit M, a current output unit S0, a comparator B and a capacitor unit C0.

The first input end of the comparator B is connected to the capacitor unit C0, the second input end of the comparator B inputs a default threshold voltage VT; wherein the first input end is a positive input end, and the second input end is an inverting input end. Alternatively, the first input end is an inverting input end and the second input end is a positive input end.

The current output unit S0 is connected to capacitor unit C0 for charging the capacitor unit C0.

The duty cycle detection unit M is for receiving the externally inputted PWM signal P and detecting the duty cycle of the PWM signal P.

In the instant embodiment, the duty cycle detection unit M, the current output unit S0 and the comparator B are all packaged in a single package.

When the duty cycle detection unit M detects the duty cycle is less than the default threshold, the current output unit S0 increases the output current or the capacitor unit C0 reduces the provided capacitance to reduce the time required for the voltage of the capacitor unit C0 to reach the default threshold voltage VT. In other words, under the condition of maintaining the capacitance provided the capacitor unit C0, the current output unit S0 must increase the outputted current; alternatively, under the condition of maintaining the outputted current from current output unit S0, the capacitor unit C0 provides a smaller capacitance. In this manner, regardless of increasing the current or reducing the capacitance, the charging speed for the capacitor unit CO will increase so that the voltage of the capacitor unit C0 can reach the default threshold voltage VT sooner. As such, the comparator B can compare faster to avoid flickering problem.

Figure 3:
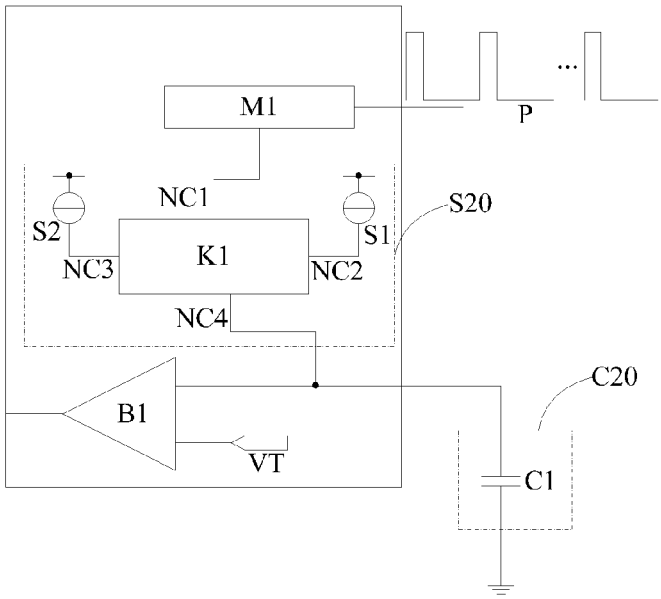
FIG. 3 is a schematic view showing the circuit of the second embodiment of an LED Light-adjustment driver module according to the present invention.

Referring to FIG. 3, FIG. 3 is a schematic view showing the circuit of the second embodiment of an LED light-adjustment driver module according to the present invention. The LED light-adjustment driver module comprises a duty cycle detection unit M1, a current output unit S20, a comparator B1 and a capacitor unit C20. The duty cycle detection unit M1 and, the comparator B1 of the instant embodiment have the same features as those in the first embodiment, and thus the description will not be repeated here.

In the instant embodiment, the capacitance provided by the capacitor unit C20 remains unchanged, and the current output unit S20 increase outputted current. When the duty cycle detection unit M1 detects the duty cycle is less than the default threshold, the current output unit S20 outputs a first current; the duty cycle detection unit M1 detects the duty cycle is larger than the default threshold, the current output unit S20 outputs a second current; wherein the second current is smaller than the first current.

Specifically, the current output unit 520 comprises a first control switch K1, a first current source S1 and a second current source S2; the capacitor unit C20 comprises a first capacitor C1.

When duty cycle detection unit M1 detects the duty cycle of the PWM signal P is less than a default threshold, a first control signal is transmitted to the first control switch K1; when duty cycle detection unit M1 detects the duty cycle of the PWM signal P is larger than a default threshold, a second control signal is transmitted to the first control switch K1.

The first control switch K1 comprises a first end NC1, a second end NC2, a third end NC3 and a fourth end NC4. The first end NC1 is connected to the duty cycle detection unit M1. When the first end NC1 receives the first control signal, the fourth end NC4 is connected to the second end NC2; and when the first end NC1 receives the second control signal, the fourth end NC4 is connected to third end NC3.

The first current source S1 is connected to the second end NC2 of the first control switch K1 and outputs a first current; and the second current source S2 is connected to the third end NC3 of the first control switch K1 and outputs a second current.

One end of the first capacitor C1 is connected to the fourth end NC4 of the first control switch K1 and the first input end of the comparator B1; and the other end of the first capacitor C1 is grounded.

Therefore, the increasing outputted current by the current output unit S0 only occurs when the duty cycle is less than a default threshold. It is known to those with ordinary skill in the field that when the output current increases, the voltage of the capacitor unit C20 must start at 0 at the moment when the power switches on so that the entire LED light-adjustment driver module is in a near-short state and generates a huge peak current. This peak current is also called inrush current (or surge current). The inrush current is usually 20-1000 times of the normal operating current peak, and can bring much trouble to power supply manufacturer, especially when the application demands high reliability and safety. Therefore, industry defines restrict specification for the inrush current.

If the current output unit S20 increases the current regardless that the duty cycle is less or larger than the default threshold, the inrush current will be generated, which is bad for the LED light-adjustment driver module. Therefore, in the instant embodiment, the current output unit S20 generates a first current only when the duty cycle is less than the default threshold, and generates a second current only when the duty cycle is larger than the default threshold so that the inrush current can be avoided to improve the reliability and safety of the LED light-adjustment driver module.

Through disposing the first control switch K1 the LED light-adjustment driver module of the present embodiment can switch between the first current source S1 and the second current source S2 to output different current according to the output of the duty cycle detection unit M1. When the duty cycle is less than the default threshold, the LED light-adjustment driver module provides a larger current to the first capacitor C1; when the duty cycle is larger than the default threshold, the LED light-adjustment driver module can suppress the inrush current to improve operation reliability.

Figure 4:
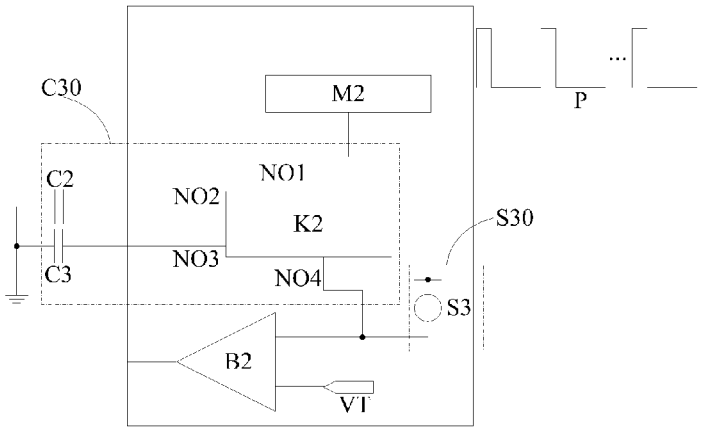
FIG. 4 is a schematic view showing the circuit of the third embodiment of an LED light-adjustment driver module according to the present invention.

Referring to FIG. 4, FIG. 4 is a schematic view showing the circuit of the third embodiment of an LED light-adjustment driver module according to the present invention. The LED light-adjustment driver module comprises a duty cycle detection unit M2, a current output unit S30, a comparator B2 and a capacitor unit C30. The duty cycle detection unit M2 and the comparator B2 of the instant embodiment have the same features as those in the first embodiment, and thus the description will not be repeated here.

In the instant embodiment, the current outputted by the current output unit. S30 remains unchanged, and the capacitor unit. C30 reduces the provided capacitance. When the duty cycle detection unit M2 detects the duty cycle is less than the default threshold, the capacitor unit C30 provides a first capacitance; when the duty cycle detection unit M2 detects the duty cycle is larger than the default, threshold, the capacitor unit C30 provides a second capacitance; wherein the first capacitance is less than the second capacitance.

Specifically, the current output unit S30 comprises a third current source S3, and the capacitor unit C30 comprises a second control switch K2, a second capacitor C2 and a third capacitor C3.

When duty cycle detection unit M1 detects the duty cycle of the PWM signal P is less than a default threshold, a first control signal is transmitted to the second control switch K2; when duty cycle detection unit M1 detects the duty cycle of the PWM signal P is larger than a default threshold, a second control signal is transmitted to the second control switch K2.

The second control switch K2 comprises a first end N01, a second end NO2, a third end NO3 and a fourth end N04. The first end NO1 is connected to the duty cycle detection unit M2. When the first end NO1 receives the first control signal, the fourth end N04 is connected to the second end NO2; and when the first end NO1 receives the second control signal, the fourth end N04 is connected to third end NO3.

One end of the second capacitor C2 is connected to the second end NO2 of the second control switch K2, and the other end of the second capacitor C2 is grounded. The second capacitor C2 provides a first capacitance. One end of the third capacitor C3 is connected to third end NO3 of the second control switch K2, and the other end of the third capacitor C3 is grounded. The third capacitor C3 provides a second capacitance.

The third current source S3 is connected to the fourth end NO4 of the second control switch K2 and the first input end of the comparator B2.

For the capacitor unit C30, the reduction of provided capacitance only occurs during the duty cycle less than the default threshold, and can avoid the occurring of inrush current. The specific realization is similar to the current output unit S20 of the second embodiment. The description will not be repeated here.

Through disposing the second control switch K2, the LED light-adjustment driver module of the present embodiment can switch between the second capacitor C2 and the third capacitor C3 to provide different capacitance according to the output of the duty cycle detection unit M2. When the duty cycle is less than the default threshold, the LED light-adjustment driver module provides a smaller capacitance to the third current source S3; when the duty cycle is larger than the default threshold, the LED light-adjustment driver module can suppress the inrush current to improve operation reliability.

The present invention further provides a backlight module. The backlight module comprises: an LED light and the LED light-adjustment driver module. The output end of the comparator outputting a high level or a low level to adjust the luminance of the LED light to achieve the object of light adjustment.

The present invention further provides a liquid crystal display device. The liquid crystal display device comprises the above backlight module. The remaining structure of the backlight module and the liquid crystal display device refer to the known technique, and the description will not be repeated here.

As such, the LED light-adjustment driver module, backlight module and LCD of the present invention can increase the charging speed of the capacitor unit to reduce the time required for the voltage of the capacitor unit to reach the threshold voltage, avoid the flickering problem and improve the lighting quality. In addition, through disposing the first control switch or the second control switch, the present invention can avoid the inrush current to improve the operation reliability.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. An LED light-adjustment driver module, which comprises: a duty cycle detection unit, a current output unit, a comparator and a capacitor unit;

wherein a first input end of the comparator being connected to the capacitor unit, a second input end of the comparator inputting a default threshold voltage;

the current output unit being connected to the capacitor unit for charging the capacitor unit;

the duty cycle detection unit being for receiving an externally inputted PWM signal and detecting a duty cycle of the PWM signal;

when the duty cycle detection unit detecting the duty cycle being less than a default threshold, the current output unit increasing an output current or the capacitor unit reducing the capacitance provided to reduce a time for the voltage of the capacitor unit to reach a threshold voltage.

2. The LED light-adjustment driver module as claimed in claim 1, characterized in that when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

3. The LED light-adjustment driver module as claimed in claim 1, characterized in that when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

4. The LED light-adjustment driver module as claimed in claim 2, characterized in that the current output unit comprises a first control switch, a first current source and a second current source; the capacitor unit comprises a first capacitor;

wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch;

the first control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

the first current source is connected to the second end of the first control switch and outputs a first current;

the second current source is connected to the third end of the first control switch and outputs a second current; and one end of the first capacitor is connected to the fourth end of the first control switch and the first input end of the comparator; the other end of the first capacitor is grounded.

5. The LED light-adjustment driver module as claimed in claim 3, characterized in that the current output unit comprises a third current source; the capacitor unit comprises a second control switch, a second capacitor and a third capacitor;

wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch;

the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

one end of the second capacitor is connected to the second end of the second control switch; the other end of the second capacitor is grounded; the second capacitor provides a first capacitance;

one end of the third capacitor is connected to the third end of the second control switch;

the other end of the third capacitor is grounded; the third capacitor provides a second capacitance; and the third current source is connected to the fourth end of the second control switch and the first input end of the comparator.

6. The LED light-adjustment driver module as claimed in claim 1, characterized in that the duty cycle detection unit, the current output unit and the comparator are packaged in a single package.

7. A backlight module, which comprises an LED light and an LED light-adjustment driver module, the LED light-adjustment driver module comprising: a duty cycle detection unit, a current output unit, a comparator and a capacitor unit;

wherein a first input end of the comparator being connected to the capacitor unit, the second input end of the comparator inputting a default threshold voltage;

the current output unit being connected to the capacitor unit for charging the capacitor unit;

the duty cycle detection unit being for receiving an externally inputted PWM signal and detecting a duty cycle of the PWM signal;

when the duty cycle detection unit detecting the duty cycle being less than a default threshold, the current output unit increasing an output current or the capacitor unit reducing the capacitance provided to reduce a time for the voltage of the capacitor unit to reach a threshold voltage; an output end of the comparator outputting a high level or a low level to adjust a luminance of the LED light.

8. The backlight module as claimed in claim 7, characterized in that when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

9. The backlight module as claimed in claim 7, characterized in that when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

10. The backlight module as claimed in claim 8, characterized in that the current output unit comprises a first control switch, a first current source and a second current source; the capacitor unit comprises a first capacitor;

wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch;

the first control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

the first current source is connected to the second end of the first control switch and outputs a first current;

the second current source is connected to the third end of the first control switch and outputs a second current; and one end of the first capacitor is connected to the fourth end of the first control switch and the first input end of the comparator; the other end of the first capacitor is grounded.

11. The backlight module as claimed in claim 9, characterized in that the current output unit comprises a third current source; the capacitor unit comprises a second control switch, a second capacitor and a third capacitor;

wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch;

the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

one end of the second capacitor is connected to the second end of the second control switch; the other end of the second capacitor is grounded; the second capacitor provides a first capacitance;

one end of the third capacitor is connected to the third end of the second control switch; the other end of the third capacitor is grounded; the third capacitor provides a second capacitance; and the third current source is connected to the fourth end of the second control switch and the first input end of the comparator.

12. The backlight module as claimed in claim 7, characterized in that the duty cycle detection unit, the current output unit and the comparator are packaged in a single package.

13. A liquid crystal display device, which comprises a backlight module, the backlight module comprising: an LED light and an LED light-adjustment driver module, the LED light-adjustment driver module comprising: a duty cycle detection unit, a current output unit, a comparator and a capacitor unit;

wherein a first input end of the comparator being connected to the capacitor unit, a second input end of the comparator inputting a default threshold voltage;

the current output unit being connected to the capacitor unit for charging the capacitor unit;

the duty cycle detection unit being for receiving an externally inputted PWM signal and detecting a duty cycle of the PWM signal;

when the duty cycle detection unit detecting the duty cycle being less than a default threshold, the current output unit increasing an output current or the capacitor unit reducing a capacitance provided to reduce a time for the voltage of the capacitor unit to reach the threshold voltage; an output end of the comparator outputting a high level or a low level to adjust a luminance of the LED light.

14. The liquid crystal display device as claimed in claim 13, characterized in that when the duty cycle detection unit detects the duty cycle being less than the default threshold, the current output unit outputs a first current; when the duty cycle detection unit detects the duty cycle being larger than the default threshold, the current output unit outputs a second current; wherein the second current is smaller than the first current.

15. The liquid crystal display device as claimed in claim 13, characterized in that when the duty cycle detection unit detects the duty cycle being less than the default threshold, the capacitor unit provides a first capacitance; when the duty cycle detection unit detects the duty cycle being larger than the default threshold, the capacitor unit provides a second capacitance; wherein the first capacitance is smaller than the second capacitance.

16. The liquid crystal display device as claimed in claim 14, characterized in that the current output unit comprises a first control switch, a first current source and a second current source; the capacitor unit comprises a first capacitor;

wherein when the duty cycle detection unit detects the duty cycle being less than the default threshold, a first control signal is transmitted to the first control switch; when the duty cycle detection unit detects the duty cycle being larger than the default threshold, a second control signal is transmitted to the first control switch;

the first control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

the first current source is connected to the second end of the first control switch and outputs a first current;

the second current source is connected to the third end of the first control switch and outputs a second current; and one end of the first capacitor is connected to the fourth end of the first control switch and the first input end of the comparator; the other end of the first capacitor is grounded.

17. The liquid crystal display device as claimed in claim 15, characterized in that the current output unit comprises a third current source; the capacitor unit comprises a second control switch, a second capacitor and a third capacitor;

wherein when the duty cycle detection unit detects the duty cycle being less than the default threshold, a first control signal is transmitted the second control switch; when the duty cycle detection unit detects the duty cycle being larger than the default threshold, a second control signal is transmitted the second control switch;

the second control switch comprises a first end, a second end, a third end and a fourth end; the first end is connected to the duty cycle detection unit; when the first end receives the first control signal; the fourth end is connected to the second end; when the first end receives the second control signal; the fourth end is connected to the third end;

one end of the second capacitor is connected to the second end of the second control switch; the other end of the second capacitor is grounded; the second capacitor provides a first capacitance;

one end of the third capacitor is connected to the third end of the second control switch; the other end of the third capacitor is grounded; the third capacitor provides a second capacitance; and the third current source is connected to the fourth end of the second control switch and the first input end of the comparator.

18. The liquid crystal display device as claimed in claim 13, characterized in that the duty cycle detection unit, the current output unit and the comparator are packaged in a single package.

* * * * *